US005111967A

United States Patent [19]

Schreiber

[11] Patent Number: 5,111,967

[45] Date of Patent: May 12, 1992

[54] DISPENSING CLOSURE FOR A CONTAINER

[76] Inventor: Alexander R. Schreiber, 159 Windsong St., Thousand Oaks, Calif. 91360

[21] Appl. No.: 653,505

[22] Filed: Feb. 11, 1991

[51] Int. Cl.[5] ..... B67D 5/32; B67D 3/00

[52] U.S. Cl. ..... 222/39; 222/519; 222/542; 222/549

[58] Field of Search ..... 222/39, 519, 520, 521, 222/542, 562, 41, 549

[56] References Cited

U.S. PATENT DOCUMENTS

| | | | |
|---|---|---|---|
| 1,524,131 | 1/1925 | Haskell | 222/519 |
| 2,368,836 | 2/1945 | Holwick | 222/519 |
| 2,582,026 | 1/1952 | Friedman | 222/542 |
| 2,591,231 | 4/1952 | Boadway | 222/542 |
| 2,860,821 | 11/1958 | Hartung et al. | 222/519 |
| 3,121,519 | 2/1964 | Cherba | 222/519 |
| 3,261,513 | 7/1966 | Moran | 222/519 |
| 3,406,879 | 10/1968 | Stull | 222/520 |
| 3,606,105 | 9/1971 | Santone | 222/520 |
| 3,834,596 | 9/1974 | Brady et al. | 222/520 |
| 4,477,002 | 10/1984 | Stull | 222/520 |

FOREIGN PATENT DOCUMENTS

| | | | |
|---|---|---|---|
| 833362 | 2/1970 | Canada | 222/520 |
| 3514132 | 10/1986 | Fed. Rep. of Germany | 222/519 |
| 45745 | 11/1935 | France | 222/520 |

*Primary Examiner*—Donald T. Hajec
*Assistant Examiner*—Kenneth Bomberg

[57] ABSTRACT

A twist open, twist close outer plastic cap with a modified container neck having multiple annular fluid seals and a dispensing aperture located on an outer annular beveled corner of the cap. The twist open/close closure involves raising and lowering the cap on cooperatively structured threads on the neck of the container and interior of the outer plastic cap. Two different consistencies of plastic material are used to structure the outer cap to provide a relatively rigid outer cap structure having a relatively soft interior surface for improved sealing against the neck of the container. A first stop block is located on the lower exterior of the container neck, and a second stop block aligned for abutment with the first block is located on the lower interior of the cap to limit rotation of the outer cap. Cooperative alignable structures between the outer cap and the neck of the container causes a definite snap or vibration in the outer cap at about the moment the dispensing aperture is fully opened to alert the user to the open condition.

2 Claims, 5 Drawing Sheets

DISPENSING CLOSURE FOR A CONTAINER

BACKGROUND OF THE INVENTION

1. Field of the Invention

This invention relates to closeable dispensing structures for small hand held containers. More precisely the invention is an improved closure comprising a plastic outer cap and cooperatively structured container neck.

2. Description of the Prior Art

A wide variety of dispensing closures have been introduced over the years for dispensing an almost unlimited assortment of products such as shampoo, lotion, or powders from small hand held containers. A feature common to many of these closures is that the cap is permanently yet movably retained onto a container neck, and the dispensing aperture is opened by a rotating or pulling motion applied to the outer cap. A problem common to many of the fluid dispensing closures appears to be a weakness in the sealing often resulting in messy leakage. This is especially evident during shipping when the containers are exposed to altitude changes and the resultant significant changes in air pressure and temperature. Also, during shipping or in a suitcase or travel bag, dispensing containers are often tipped on their sides resulting in leaks. It has been estimated that for every one closure fluid leak reported to the manufacture of the closure, that there are at least fifty closure leaks that go un-reported.

Additional problems with many past art closures are the level of convenience for users, and structuring which makes it difficult to retrieve the last remaining small quantity of product in the container. I am not aware of any prior art closures which are structured the same as my invention, or provide the same advantages.

SUMMARY OF THE INVENTION

My invention is a twist open, twist close dispensing closure comprising a plastic outer cap for use with a cooperatively structured container neck of a container. My closure is primarily structured for, but not limited to dispensing fluids such as shampoos and lotions for example. The invention provides improved fluid sealing made possible by a dispensing aperture located on an outer annular bevelled corner of the cap, and the use of multiple annular seals, some of which are tightly engaged at all times whether the dispensing aperture of the closure is opened or closed.

The placement of my dispensing aperture on a bevelled corner of the outer cap is seen as being much more convenient for dispensing, allowing the container to be held at an approximate 45 degree angle rather than straight up vertically. The angled placement of the container during dispensing of the product allows for improved viewing of the amount of substance being dispensed, while at the same time angling and directing the last remaining small quantity of material in a nearly empty container toward the dispensing aperture to eliminate any waste.

The twist open/close operation of my closure involves raising and lowering the cap on cooperatively structured threads on the neck of the container and interior of the outer plastic cap.

Additionally, in one preferred embodiment of the invention, the cap is structured using at two different consistencies of plastic material in order to provide a relatively rigid outer cap structure having a relatively soft interior surface or lining for improved sealing against the top of the neck of the container. Also desirably part of this embodiment is a first stop block located on the lower exterior of the container neck, and a second stop block located on the lower interior of the cap to limit rotation of the cap during the process of opening the closure, this being primarily to prevent the inadvertent removal of the outer cap from the container neck.

A cooperative structure between the outer cap and the neck of the container may be provided which causes a definite snap or vibration in the outer cap at about the moment the dispensing aperture is fully opened, this being to alert the user to the open condition.

In view of the above, it should be recognised that a primary object of my invention is to provide an improved container closure with significant fluid sealing capabilities and more convenient dispensing by the user.

A further object of my invention is to provide the above in a container closure having a dispensing aperture positioned so as to allow the dispensing of virtually all of the product within the container to eliminate waste.

Another object of the invention is to provide the above in a container closure having structure which clearly indicates to the user an open dispensing aperture.

A further object of my invention is to provide the above in a container closure comprised of an outer cap and a specifically structured container neck on a container, all of which may be manufactured quickly and inexpensively with modern automated manufacturing equipment.

An even further object of my invention is to provide the above in a closure which may be adapted to be utilized with a bottle, squeeze tube or other similar container.

DESCRIPTION OF THE PREFERRED EMBODIMENTS

Figure 8:
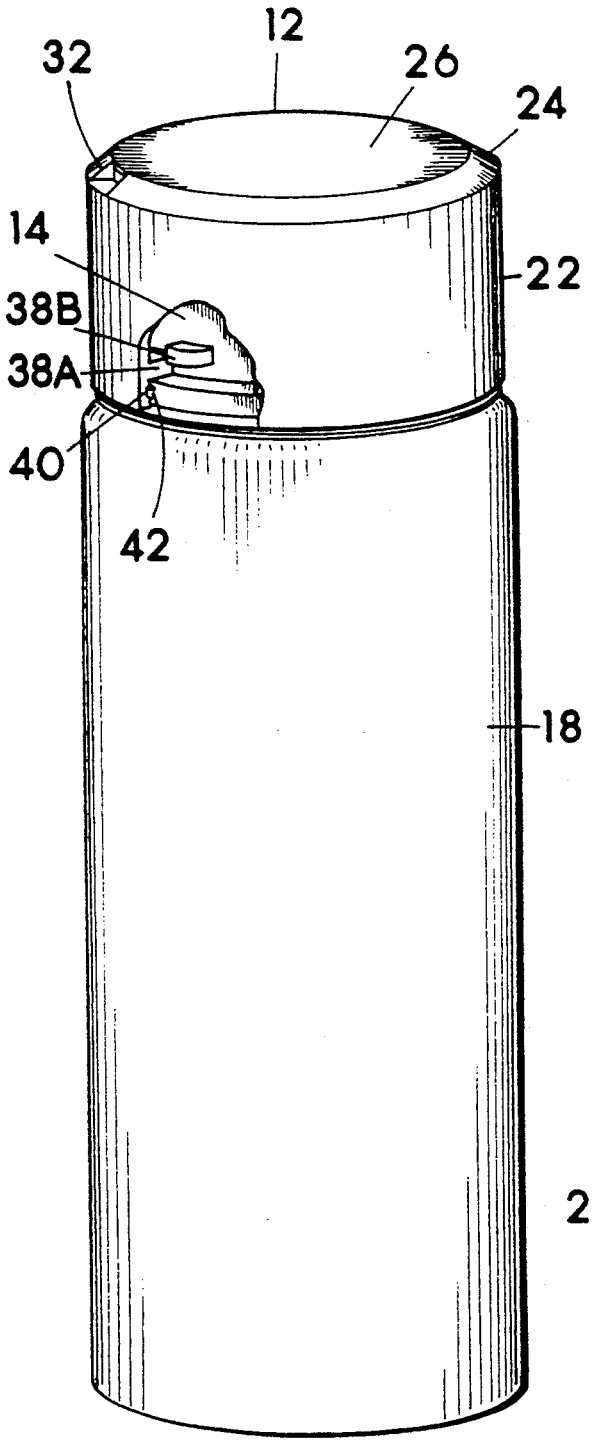
FIG. 8 is illustrative of the invention utilized on a bottle. A cut-away of the sidewall of the outer cap is used to show the abutment of the stop blocks with the closure in the fully open position.
Figure 9:
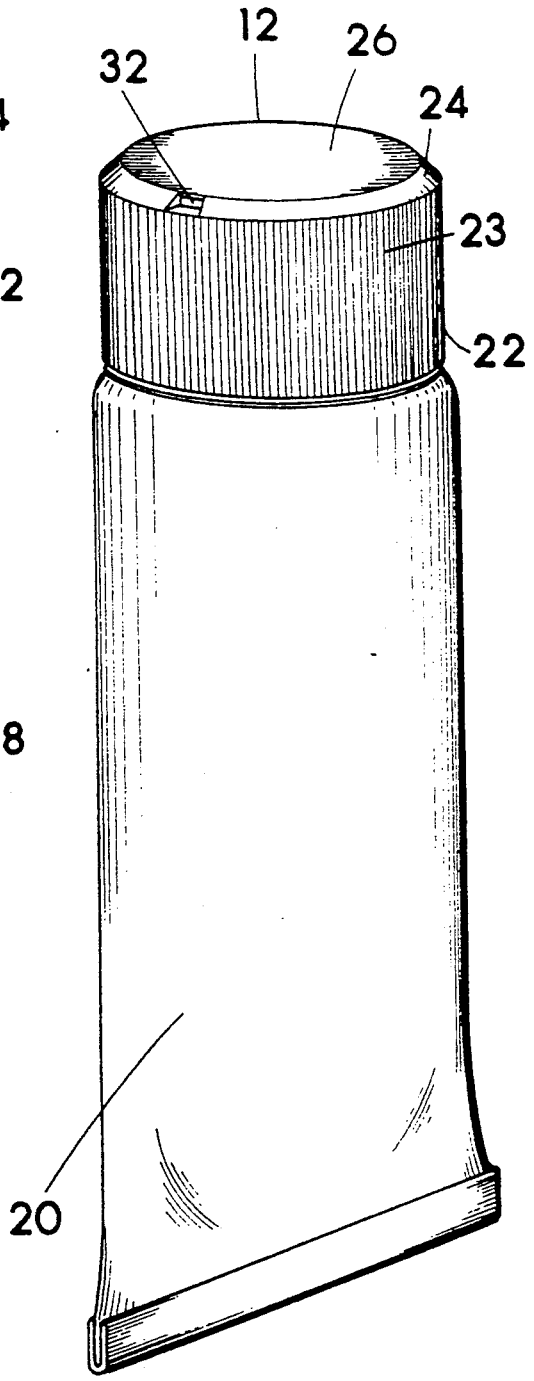
FIG. 9 is illustrative of the invention utilized on a squeeze tube container. Striations are shown on the outer surface of the cap.

Referring now to the drawings where a preferred embodiments of the invention are illustrated in numerous figures so as to assist the reader in understanding the following written description. The invention is comprised of a rotary style outer cap 12 structured to fit over and cooperate with a container neck 14 attached to a container 16. Container 16, being a generic term for any suitable container, may be a bottle 18 style container as shown in FIG. 8, or may be a squeeze tube 20 style container as shown in FIG. 9. Container neck 14 is the tubular member open at two oppositely disposed ends, one open end being in open communication with the interior of container 16. Container neck 14 defines a portion of the dispensing flow path 50 which extends from within container 16 up through the open center of neck 14 and out through dispensing aperture 32.

Figure 1:
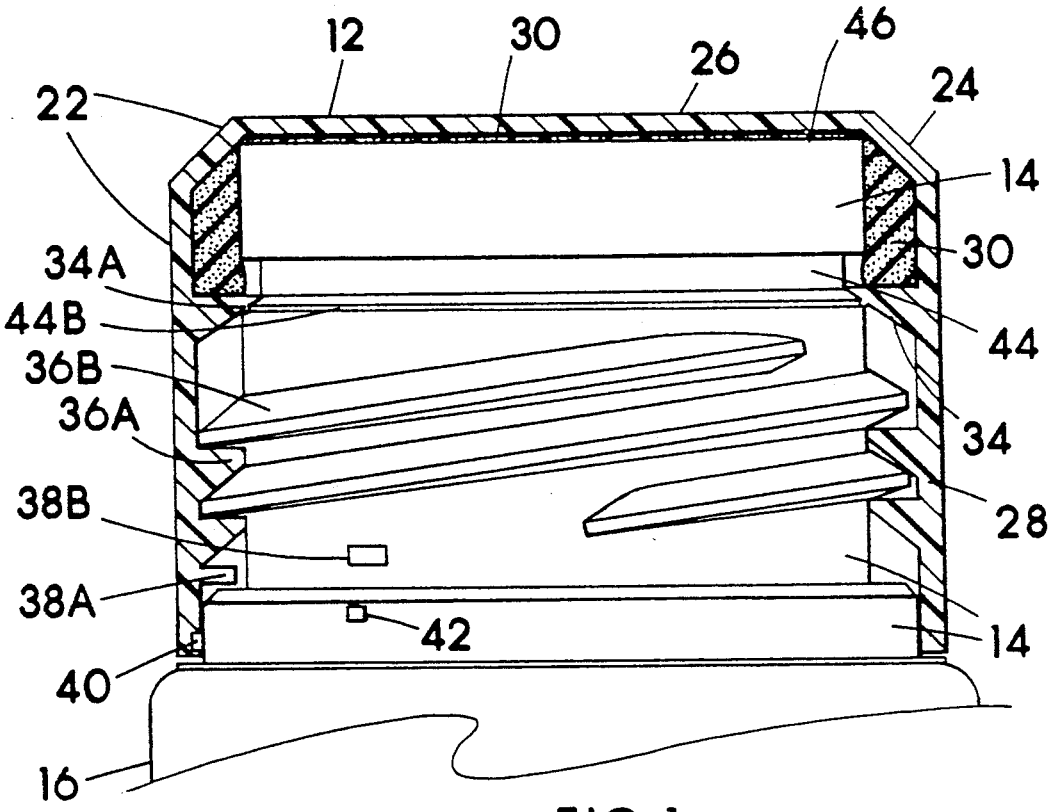
FIG. 1 is a view of a cross sectioned outer cap attached to a non-sectioned container neck. Both the outer cap and the container neck are structured in accordance with a preferred embodiment of the invention. The closure is closed and all seals are engaged.
Figure 2:
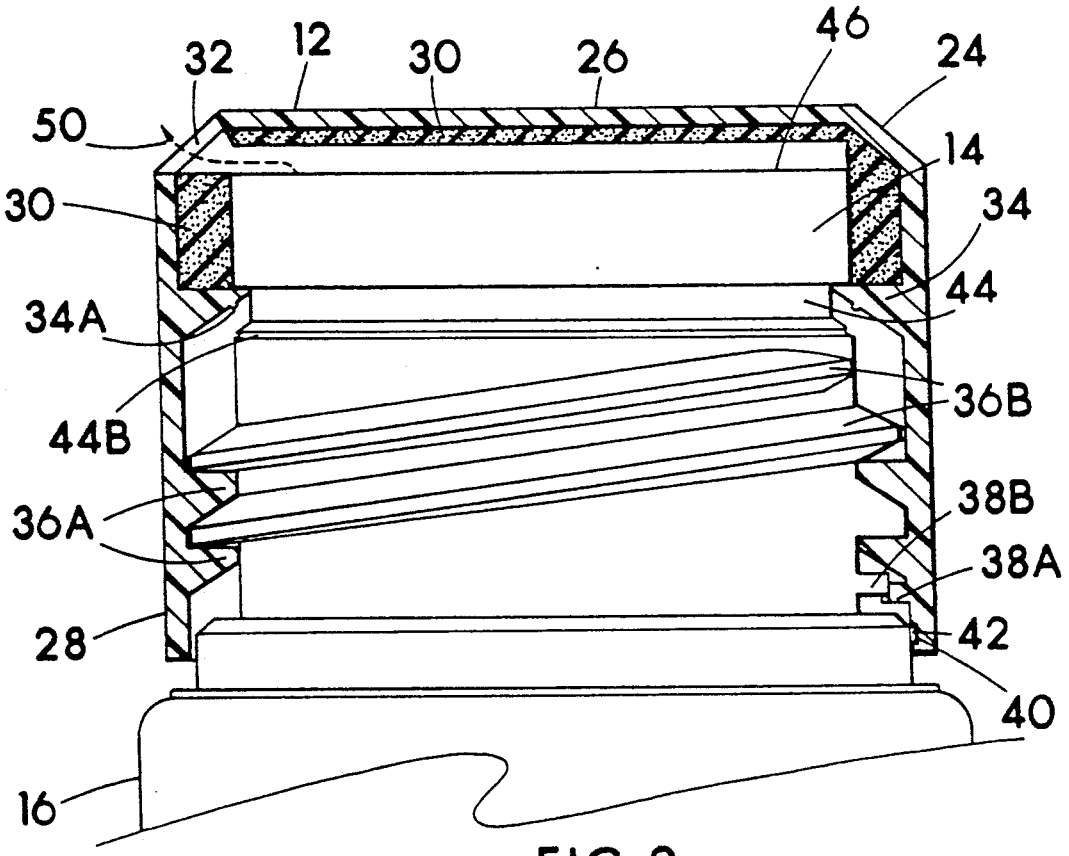
FIG. 2 is a view of the cap and container neck of FIG. 1. The closure is open. The container neck has been rotated a little over 90 degrees counterclockwise from that shown in FIG. 1. The cap has been rotated counterclockwise relative to the container neck as compared to FIG. 1 in order to open the closure.

Cap 12 is comprised an annular sidewall 22 which may be structured with exposed striations 23 or other non-slip features as shown in FIG. 9, or may be smooth surfaced as shown in FIG. 8. Striations 23 may be desirable when the container 16 contains a product such as shampoo where the container is used in wet conditions such as a shower, and a non-slip surface is more desireable. Sidewall 22 is closed at the top by an attached cap top 26, and left open at the bottom or oppositely disposed end from cap top 26 to allow placement of the cap 12 over neck 14. At the corner or juncture of cap top 26 with sidewall 22 is an annular bevel 24. Bevel 24 may be considered an angled portion of cap top 26, or may be considered an angled portion of sidewall 22, however, I consider it a portion of sidewall 22 as indicated in the left hand side of FIG. 1. Dispensing aperture 32 extends through cap 12, from the exterior to the interior of the cap 12 as shown in FIG. 2. Dispensing aperture 32 is placed at or adjacent the corner of cap 12 defined by the intersecting surfaces of cap top 26 and sidewall 22 in bevel 24. The placement of dispensing aperture 32 in bevel 24 allows for convenient and controlled dispensing, in that container 16 may be held at an approximate 45 degree angle with aperture 32 aiming straight downward. This straight downward positioning of dispensing aperture 32 with container 16 at a 45 degree angle directs all remaining flowable material in the container toward dispensing aperture 32, and additionally, all of the plastic material surrounding and defining dispensing aperture 32 extends upward from around the aperture 32, thereby reducing any chance of uncontrolled dribbling of material during dispensing. It should be noted that bevel 24 is not absolutely essential to the invention, in that a substantially 90 degree corner between cap top 26 and sidewall 22 would function reasonably well. With the hypothetical 90 degree corner arrangement, dispensing aperture 32 would be placed in sidewall 22 adjacent the intersection of cap top 26 with sidewall 22, although it may be possible to place dispensing aperture 32 in cap top 26 directly adjacent the corner defined by the intersection of cap top 26 with sidewall 22. Additionally, bevel 24 need not be annular and encircling the entire cap 12. Bevel 24 could be just a short angled plane large enough for the placement of dispensing aperture 32 therein, thereby providing the same benefits as that of an annular bevelled corner 24.

Cap 12 in its preferred form is manufactured of two different consistencies of plastic material in order to provide a relatively rigid outer cap shell structure having a relatively soft interior surface for improved sealing against neck 14 of container 16. In the cross sectional drawings of cap 12, the outer portion or shell of cap 12 is made of relatively rigid polypropylene or polyethylene for example, designated rigid plastic 28. Rigid plastic 28 is necessarily somewhat flexible to allow the initial installation of cap 12 onto neck 14, but is relatively rigid as compared to soft plastic 30 shown in the interior of cap 12 toward the closed end. Soft plastic 30 is substantially more pliable than rigid plastic 28, and will provide improved sealing as will be appreciated with continued reading. Soft plastic 30 may be neoprene or any highly pliable material impervious to the passage of fluid such as a polyurethane elastomer for example. Soft plastic 30 is preferably positioned on the interior or underside surface of cap top 26 so as to be engageable with the entire annular top surface 46 of neck 14, and is desirably additionally sized and positioned extending partially downward around the interior surface of sidewall 22 to fit encircling with interference against the annular exterior top side surface of neck 14 for additional sealing or back-up sealing, which will be explained in greater detailing later.

Cap 12 has threads 36 A attached to and extending inward from the interior surface of sidewall 22. Cap 12 has an annular main tongue 34 attached to an extending inward from the interior surface of sidewall 22. Main tongue 34 preferably has a small annular back-up tongue 34 A exposed on an underside thereof. Both annular main tongue 34 and back-up tongue 34 A form the tongue portions of tongue and groove fluid seals which will be explained in greater detail later. Annular main tongue 34 is positioned in the interior of cap 12 between threads 36 A and the bottom terminal edge of soft plastic 30 as shown in FIG. 1 and 2 where soft plastic 30 terminates against the top surface of main tongue 34.

Additionally, on the interior surface of sidewall 22 of cap 12 is a stop block 38 A extending inward toward container neck 14 in use. Stop block 38 A is positioned below threads 36 A toward the terminal bottom edge of sidewall 22 adjacent the open end of cap 12. Stop block 38 A functions in conjunction with a stop block 38 B on the exterior of container neck 14 to limit rotation of cap 12, and will be further explained later. Positioned below stop block 38 A on the interior surface of sidewall 22 adjacent the terminal bottom edge of sidewall 22 of cap 12 is a small recess or receiver socket designated recess 40. Recess 40 functions in conjunction with a small extending bump or knob 42 on the lower exterior surface of neck 14, this to being explained in greater detail later.

Cap 12 is ideally manufactured with automated thermoplastic injection molding technology. Using plastic injection molding, rigid plastic 28 of cap 12 may be shaped, and a previously properly shaped soft plastic 30 insert may be glued or otherwise affixed in place within the interior of cap 12 as a secondary process. The secondary process of placing soft plastic 30 may be eliminated by using a single injection mold tool in an injection molding machine having two bulk plastic material hoppers and two plastic injector screws, or with two injection molding machines coupled together so as to be able to inject rigid plastic 28 followed by injecting soft plastic 30 using a process known as dual or co-injection molding. The process known as dual or co-injecting of thermoplastic is one which will allow the molding of cap 12 with the two different consistencies of plastic quickly and relatively inexpensively before the mold is opened and the completed cap 12 is ejected, and is therefore the preferred method.

Figure 7:
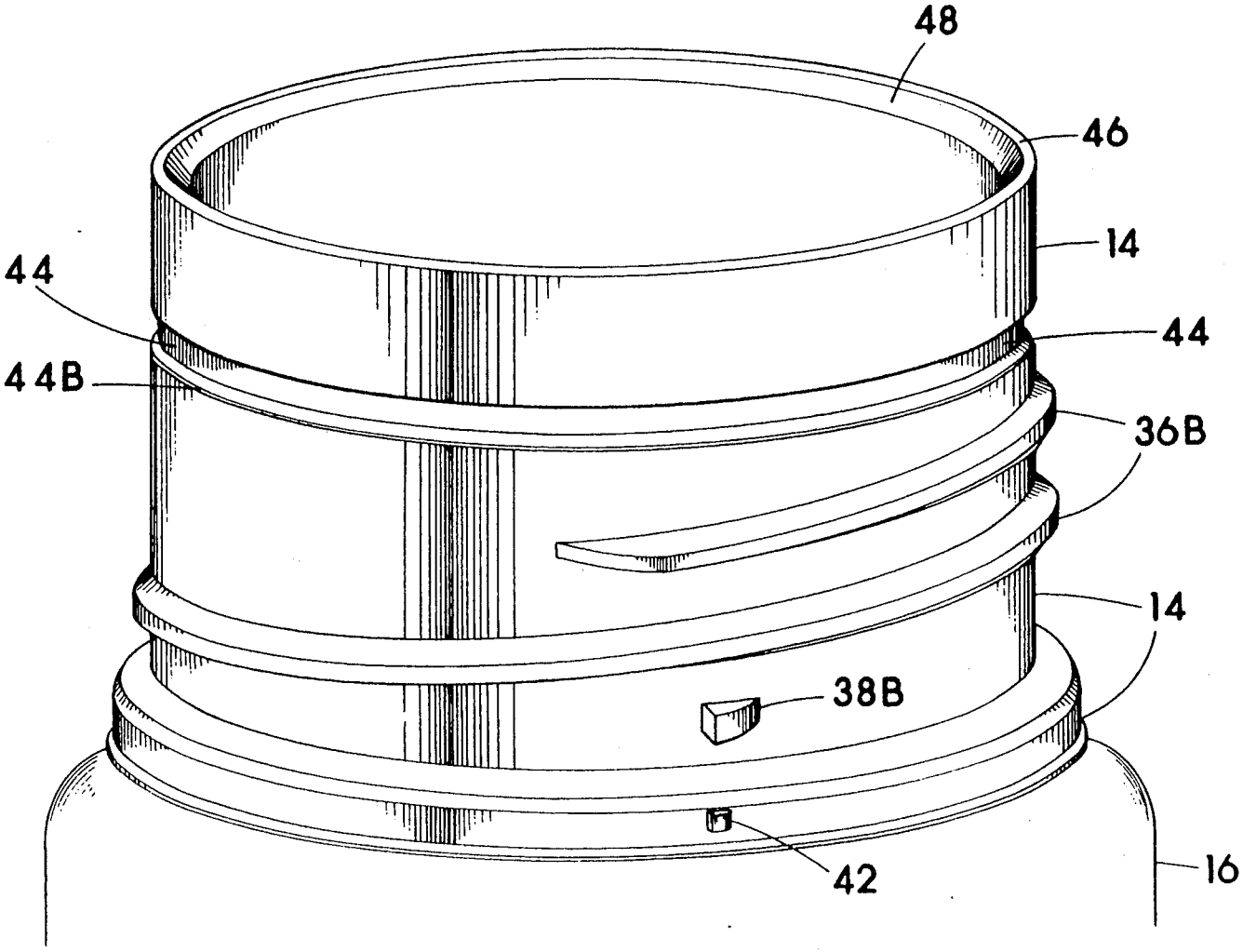
FIG. 7 is an enlarged view of a preferred container neck.

Container neck 14 in shown in most of the drawing figures, but is shown best in the enlarged view of FIG. 7. Container neck 14 in its preferred embodiment may be completely rigid or slightly flexible. In most cases it will be an inherent portion of a extruded or injection blow molded plastic bottle made of high density polyethylene or other suitable material. The exterior surface of neck 14 is structured with threads 36 B, structured to cooperate with threads 36 A of cap 12. The lower exterior of neck 14 is also structured with a small knob 42 which is sized to snap into recess 40 of cap 12 with rotation of the cap. Additionally, the lower exterior of neck 14 has a stop block 38 B which works in conjunction with stop block 38 A of cap 12. In FIG. 7 stop block 38 B is shown as a wedge shaped member. Stop block 38 A is similarly shaped. The wedge shape of the stop blocks is to allow clockwise rotation of cap 12 for the initial installation of cap 12 onto neck 14 wherein the smooth angled portions of the stop blocks 38 A and 38 B abut and glide over each other, this being allowed by some flexibility and resiliency in sidewall 22 of cap 12, and the rigid plastic 28 utilized. Once the stop blocks 38 have passed each other and cap 12 is fully installed, the two flat surfaces of the wedge shaped stop blocks 38 A and B are positioned to face one another. With counterclockwise rotation of cap 12 relative to container 16, the flat surfaces of the stop blocks 38 A and B abut, and no additional counterclockwise rotation may occur.

Formed into the exterior surface of neck 14 above threads 36 B and below top surface 46 of neck 14 is an annular main groove 44 encircling neck 14, and positioned to receive main tongue 34. The height of main groove 44 is such that main tongue 34 may travel upward and remain within the groove 44 during opening of the closure, this being better understood with continued reading. Formed in the lower exterior corner of main groove 44 is annular back-up groove 44 B for receiving back-up tongue 34 A of main tongue 34. Also as part of the preferred neck 14 is an inwardly and downwardly sloped annular bevel 48 in the top interior of neck 14 adjacent top surface 46 of the neck 14. Bevel 48 serves to assist in directing any flowable material such as lotion caught between soft plastic 30 on the underside or interior surface of cap top 26 and neck top surface 46 back into neck 14 and into container 16 when closing the dispensing aperture 32. A wide flat surface neck top 46 would have a tendency to force the lotion in all directions, that is toward the inner and outer edge of the neck. When a fluid is forced toward the outer edge of the neck 14, there is increased risk of a leak occurring. The top terminal edge of neck 14 is a narrow flat annular band of material, this being for adequate surface area contact to provide fluid tight sealing directly against the underside or interior surface of cap top 26 or soft plastic 30 affixed thereto. Soft plastic 30 affixed to the underside or interior surface of rigid plastic 28 defining cap top 26 is considered to be the underside or interior surface of cap top 26. If soft plastic 30 is not used for whatever reason, then the rigid plastic 28 defining cap top 26 would be considered the underside or interior surface of cap top 26. It should also be noted the diameter of neck 14 at the top 46 thereof is of a size relative to cap 12 and the placement of dispensing aperture 32 therein so as to place dispensing 32 slightly beyond the outside diameter of the top surface 46 of neck 14 as may ascertained from FIG. 2, 3, and 4.

Figure 5:
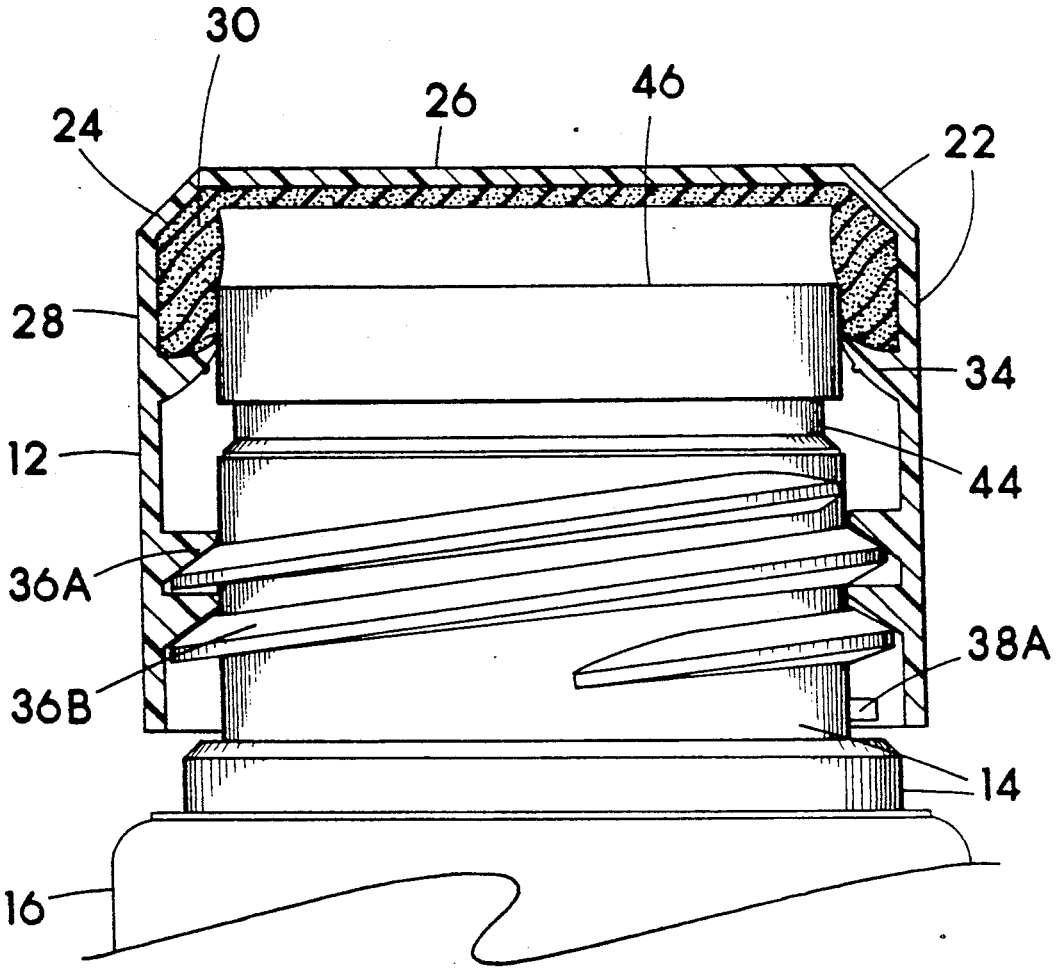
FIG. 5 is a view of the cross sectioned outer cap and the non-sectioned container neck of FIG. 1 illustrating the cap being initially installed on the neck.

In FIG. 5, cap 12 is illustrated being initially installed on neck 14 of a container 16. The initial installation would almost always be performed at a factory just after container 16 has been filled with the desired product. Initially, cap 12 is placed over neck 14 and pressed downward and rotated clockwise relative to neck 14 and container 16. Threads 36 A and 36 B engage, annular main tongue 34 flexes upward, and the annular band of soft plastic 30 along sidewall 22 engages the exterior of neck 14 being compressed to form a tight but slidable fluid seal thereagainst. The tight but slidable engagement of the annular band of soft plastic 30 along sidewall 22 against the upper exterior sidewall of neck 14 is maintained at all time once cap 12 is initially installed. Dispensing aperture extends through the annular band of soft plastic 30 along sidewall 22.

Continued clockwise rotation of cap 12 causes the slidable engagement of the sloped surface of stop block 38 A and 38 B until the blocks 38 slide beyond one another, again, this being allowed by flexing in sidewall 22 of cap 12. Additionally, main tongue 34 snaps into main groove 44. Main tongue 34 extends inward into groove 44 so as to have the terminal inward edge of tongue 34 continuously tightly yet slidably engaged against the inner most exposed surface of main groove 34, this being to form a fluid seal. Continued clockwise rotation continues to move cap 12 downward toward container 16 and eventually the interior surface of cap top 26 abuts top surface 46 of neck 14 as may be ascertained from FIG. 1 and 3. The abutment or engagement of cap top 26 against top surface 46 of neck 14 forms a fluid tight seal breaking the material flow path 50 from within container 16 through neck 14 and out dispensing aperture 32.

Figure 3:
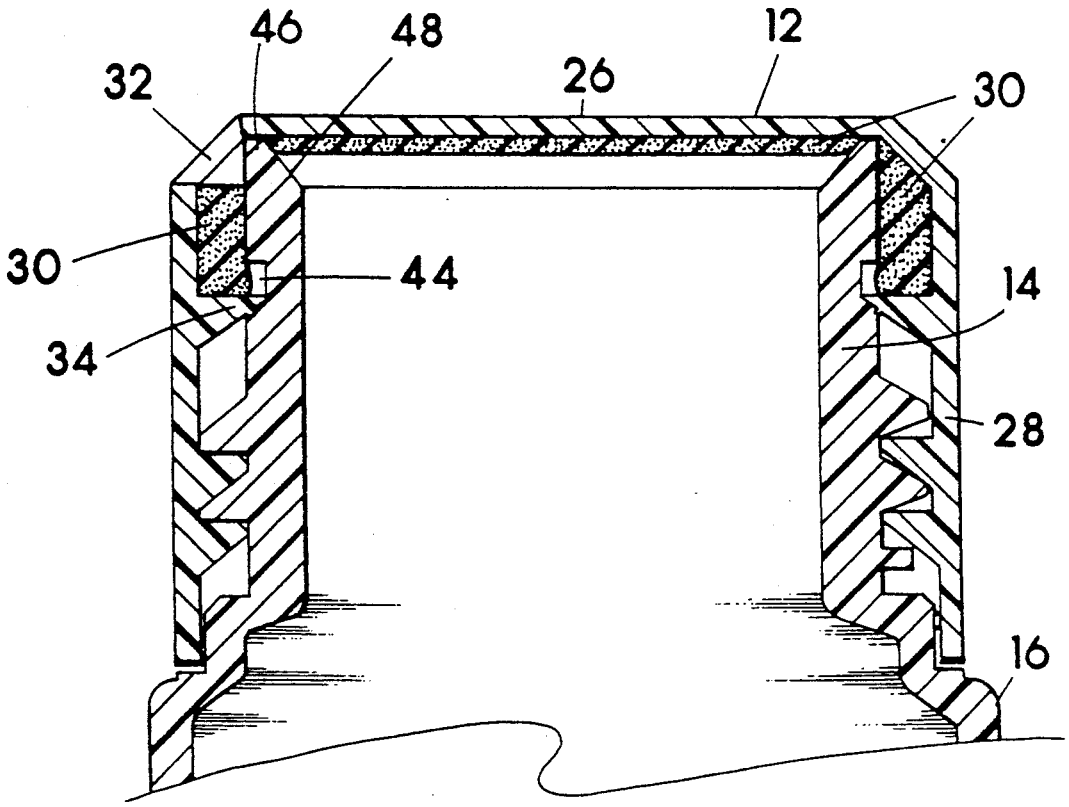
FIG. 3 is a view similar to FIG. 2, only the container neck is shown cross sectioned. The closure is in the closed position and all fluid seals are engaged.

With the closure in this fully closed position, main tongue 34 has been moved downward in main groove 44, and back-up tongue 34 A has been fully engaged within the correspondingly shaped back-up groove 44 A. Additionally, the lower interior surface of sidewall 22 is now slightly pressing against knob 42, this being by way of knob 42 extending outward into the plane that sidewall 22 in a relaxed state would occupy. Also, as shown in FIG. 3, dispensing aperture 32 is positioned slightly below the top surface 46 of neck 14. Once the underside of cap top 26 is tightly abutted against top surface 46 of neck 14, it is generally not possible, at least without stripping threads 36 A and B to further rotate cap 12 clockwise due to frictional adhering and binding, which are the rotation limiting forces in the closing procedure. As may be ascertained from FIG. 1, with cap 12 rotated fully clockwise, stop block 38 A is spaced a short distance and slightly downward from stop block 38 B. Additionally, recess 40 is spaced a short distance and slightly downward from knob 42.

Figure 4:
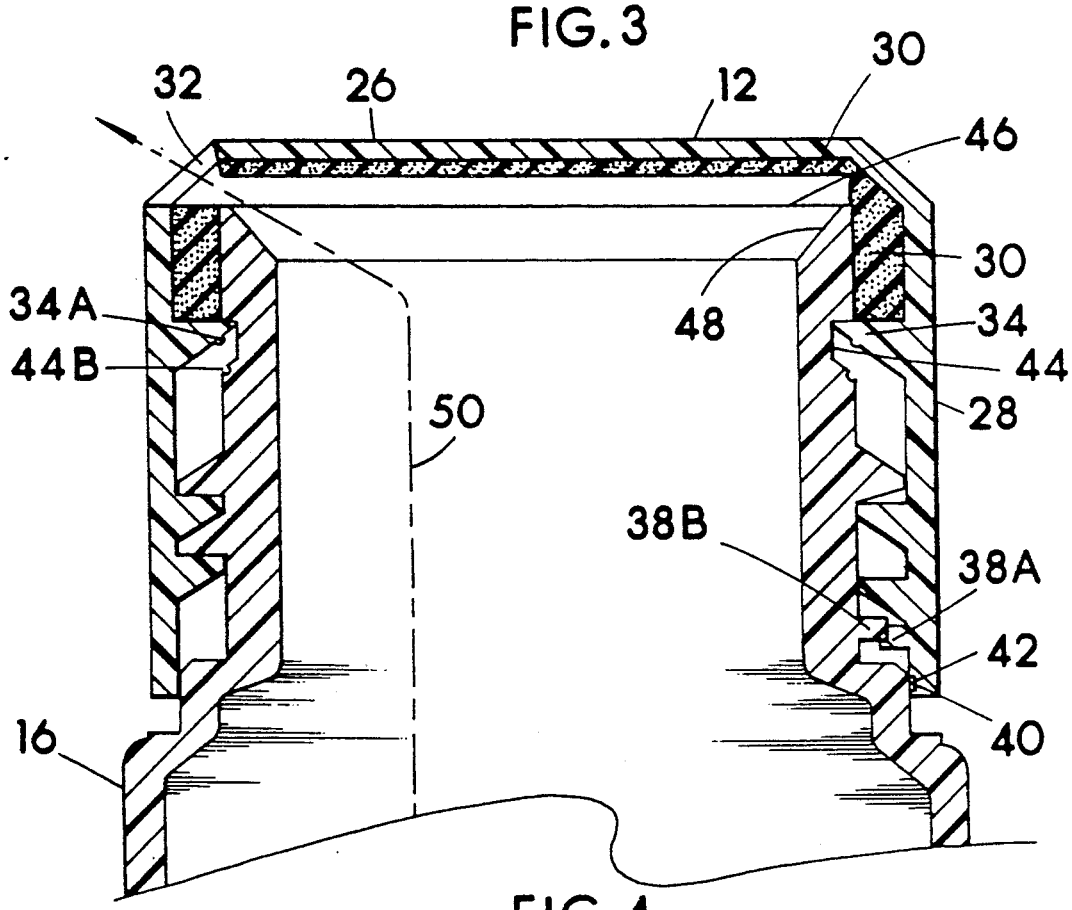
FIG. 4 is similar to FIG. 3, only the closure is in the open position.

Dispensing aperture 32 is opened or brought into communication with dispensing flow path 50 with rotation of cap 12 counterclockwise relative to container 16. Counterclockwise rotation of cap 12 causes movement or raising of the cap 12 upward or away from container 16, and moving the interior surface of cap top 26 upward away from neck top 46 as shown in FIG. 2 and 4. Counterclockwise rotation of cap 12 also moves stop block 38 A upward and toward stop block 38 B where the two blocks abut and prevent any further counterclockwise rotation of cap 12. Counterclockwise rotation of cap 12 also moves recess 40 upward and toward knob 42. Knob 42 is snapped into recess 40 making a definite snap or vibration in cap 12 at about the moment stop blocks 38 A and 38 B abut one another. The snap may be an audible signal or a signal to the user which he can feel through his fingers, or both, but in any case the user is alerted to the fully open condition of dispensing aperture 32 by knob 42 and recess 40.

The abutment of stop blocks 38 A and 38 B may serve to prevent the inadvertent removal of cap 12 from neck 14, and may serve as the indicator to the user of the fully open condition of dispensing flow path 50, this being if knob 42 and recess 40 are not used as part of the invention, the indicator from the stop blocks being the user's inability to further rotate cap 12 counterclockwise.

It is highly desirable to prevent rotation of cap 12 beyond that which is necessary to fully open the closure, and desirable to prevent inadvertent removal of cap 12 from neck 14, however, the engagement of main tongue 34 in main groove 44, and the abutment of the top edge of tongue 34 against the upper over hanging edge of groove 44 as may be ascertained from FIG. 4, may be sufficient to prevent the inadvertent removal of cap 12 from neck 14 without the use of stop block 38 A and 38 B.

Figure 6:
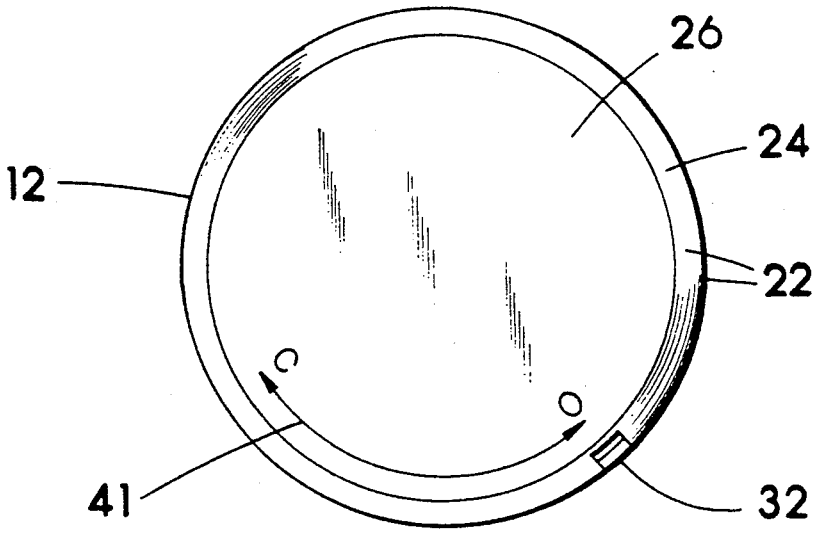
FIG. 6 is a top view of a preferred outer cap.

Also, as shown in FIG. 6, it is desirable to mold or otherwise apply instructions such as arrows and open and close indicators 41 on the top of cap 12 to inform the user to the proper direction for opening and closing the closure.

For the sake of convenience, I prefer using high lift or steeply angled threads 36 A and 36 B so that the difference between the closure being fully open and fully closed is only about one third revolution of cap 12.

Although I have very specifically described some preferred structures of the invention, it should be understood changes in the specific structures described and shown may obviously be made without departing from the scope of the invention. For instance, some of the inventive principles of my invention may be applicable to a manually pull-to-open, push-to-close closure as opposed to a rotary lift style closure as described above. Therefore the scope of the invention is not to be limited by the specification and drawings given for example, but is to be determined by the broadest possible interpretation of the appended claims and the individual words therein.

What I claim as my invention is:

1. In combination; a dispensing control cap placed over a neck of a container, said neck being a tubular structure defined by an elongated annular wall attached to said container and having an exterior surface, said cap made of plastic material and having an interior and an exterior separated and defined by a relatively rigid annular sidewall of said cap and a relatively rigid cap top attached to said sidewall by an exterior portion of said sidewall angling inward and attaching to said cap top, the angling inward of said sidewall defining an annular corner bevel of said cap, said cap top at the attachment thereof to said sidewall defining a generally closed end of said cap, said cap further having an open end oppositely disposed from said closed end of said cap, said open end of said cap placed over said neck so as to place said neck within the interior of said cap, said cap being positionable into a first position on said neck and alternately into a second position on said neck, said cap further including an annular relatively soft surface of plastic material affixed within the interior of said cap against an underside of said cap top, said soft surface sized and positioned within said cap to provide a seal when engaged with an annular top surface of said neck, the engagement of said soft surface against said top surface of said neck existing when said cap is positioned in said second position on said neck, said soft surface being disengaged from said top surface of said neck and positioned upward above said top surface of said neck when said cap is in said first position on said neck, said top surface of said neck including an annular bevel angling inward toward an open center of said neck, said annular bevel of said neck providing means for directing any existing product back into said neck upon the engagement of said soft surface against said top surface of said neck, said soft surface within said cap including an affixed annular soft side portion providing a seal engaged against and encircling an upper portion of said exterior surface of said neck adjacent said top surface of said neck, the engagement of said side portion of said soft surface against said exterior surface of said neck being maintained with said cap in said first position and maintained with said cap in said second position on said neck, said cap further including a dispensing aperture passing through said corner bevel and through said side portion of said soft surface of said cap, said cap in said first position on said neck being a position wherein said cap is raised relative to said neck and said dispensing aperture is positioned above said top surface of said neck for dispensing product from within said container by way of a dispensing flow path extending from within said container through said neck and through said dispensing aperture, said second position of said cap on said neck being a position wherein said cap is lowered relative to said neck and product dispensing from said container by way of said dispensing flow path is prevented by blockage of said dispensing aperture by the engagement of said soft surface against said top surface of said neck, said cap having threads affixed to said sidewall within the interior of said cap, said threads of said cap positioned between said open end of said cap and said side portion of said soft surface, said neck having threads affixed to said exterior surface of said neck, said threads of said neck positioned on said neck between said container and the engagement of said side portion of said soft surface against said neck, said threads of said neck cooperatively engaged with said threads of said cap so as to provide means to allow rotation of said cap on said neck and further to provide means during rotation of said cap to move said cap between said first position and said second position by way of raising and lowering said cap relative to said neck, the raising and lowering of said cap on said neck providing means for the disengagement and engagement of said soft surface against said top surface of said neck and thereby the opening and closing of said dispensing aperture, said cap further having an annular seal tongue affixed to said sidewall within the interior of said cap, said annular seal tongue extending inward toward said neck, said annular seal tongue positioned between said threads of said cap and said side portion of said soft surface of said cap, said annular seal tongue being engaged against said neck within an annular groove in said exterior surface of said neck to provide a slidable seal maintained between said cap and said neck so as to prevent product from within said container from leaking between said cap and said neck and onto the engaged said threads, said annular groove in said neck positioned between said threads of said neck and said top surface of said neck, said cap and said neck further including means for limiting the rotation of said cap from said first position into said second position so as to prevent inadvertent removal of said cap from said neck during rotation for opening of said dispensing aperture, said means for limiting the rotation of said cap including two stop blocks abutable against one another with rotation of said cap, one said stop block being affixed on said exterior surface of said neck between said container and said threads of said neck, the other of said two stop blocks being affixed on said sidewall of said cap within the interior of said cap between said open end of said cap and said threads of said cap, said cap and said neck further including vibration means for indicating an open said dispensing aperture, said vibration means including a first portion of said vibration means affixed to said sidewall of said cap within the interior of said cap, and a second portion of said vibration means affixed to said exterior surface of said neck and placed relative to said first portion of said vibration means so as to abut said first portion of said vibration means and cause a momentary snap-like vibration in said cap approximately upon the abutting of said stop blocks against one another during rotation of said cap.

2. In combination; a dispensing control cap placed over a neck of a container, said neck being a tubular structure defined by an elongated annular wall attached to said container and having an exterior surface, said cap made of plastic material and having an interior and an exterior separated and defined by a relatively rigid annular sidewall of aid cap and a relatively rigid cap top attached to said sidewall by an exterior portion of said sidewall angling inward and attaching to said cap top, the angling inward of said sidewall defining an annular corner bevel of said cap, said cap top at the attachment thereof to said sidewall defining a generally closed end of said cap, said cap further having an open end oppositely disposed from said closed end of said cap, said open end of said cap placed over said neck so as to place said neck within the interior of said cap, said cap being positionable into a first position on said neck and alternately into a second position on said neck, said cap further including an annular relatively soft surface of plastic material affixed within the interior of said cap against an under side of said cap top, said soft surface sized and positioned within said cap to provide a seal when engaged with an annular top surface of said neck, the engagement of said soft surface against said top surface of said neck existing when said cap is positioned in said second position on said neck, said soft surface being disengaged from said top surface of said neck and positioned upward above said top surface of said neck when said cap is in said first position on said neck, said soft surface within said cap including an affixed annular soft side portion providing a seal engaged against and encircling an upper portion of said exterior surface of said neck adjacent said top surface of said neck, the engagement of said side portion of said soft surface against said exterior surface of said neck being maintained with said cap in said first position and maintained with said cap in said second position on said neck, said cap further including a dispensing aperture passing through said corner bevel and through said side portion of said soft surface of said cap, said cap in said first position on said neck being a position wherein said cap is raised relative to said neck and said dispensing aperture is positioned above said top surface of said neck for dispensing product from within said container by way of a dispensing flow path extending from within said container through said neck and through said dispensing aperture, said second position of said cap on said neck being a position wherein said cap is lowered relative to said neck and product dispensing from said container by way of said dispensing flow path is prevented by blockage of said dispensing aperture by the engagement of said soft surface against said top surface of said neck, said cap having threads affixed to said sidewall within the interior of said cap, said threads of said cap positioned between said open end of said cap and said side portion of said soft surface, said neck having threads affixed to said exterior surface of said neck, said threads of said neck positioned on said neck between said container and the engagement of said side portion of said soft surface against said neck, said threads of said neck cooperatively engaged with said threads of said cap so as to provide means to allow rotation of said cap on said neck and further to provide means during rotation of said cap to move said cap between said first position and said second position by way of raising and lowering said cap relative to said neck, the raising and lowering of said cap on said neck providing means for the disengagement and engagement of said soft surface against said top surface of said neck and thereby the opening and closing of said dispensing aperture, said cap further having an annular seal tongue affixed to said sidewall within the interior of said cap, said annular seal tongue extending inward toward said neck, said annular seal tongue positioned between said threads of said cap and said side portion of said soft surface of said cap, said annular seal tongue being engaged against said neck within an annular groove in said exterior surface of said neck to provide a slidable seal maintained between said cap and said neck so as to prevent product from within said container from leaking between said cap and said neck and onto the engaged said threads, said annular groove in said neck positioned between said threads of said neck and said top surface of said neck, said annular seal tongue engaged against said neck within said annular groove in said neck additionally providing means for limiting the rotation of said cap form said first position into said second position so as to prevent inadvertent removal of said cap from said neck during rotation for opening of said dispensing aperture, said means for limiting the rotation of said cap by said annular seal tongue engaged against said neck including a top edge of said annular seal tongue abutting against an upper over hanging edge of said annular groove of said neck and thereby preventing inadvertent removal of said cap from said neck.

* * * * *